US008527205B2

(12) United States Patent
Legendre et al.

(10) Patent No.: US 8,527,205 B2
(45) Date of Patent: Sep. 3, 2013

(54) GRAVITY INTERPRETATION WORKFLOW IN INJECTION WELLS

(75) Inventors: Fabienne Legendre, Chatou (FR); Harold G. Pfutzner, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 751 days.

(21) Appl. No.: 12/545,391

(22) Filed: Aug. 21, 2009

(65) Prior Publication Data

US 2011/0042073 A1 Feb. 24, 2011

(51) Int. Cl.

| | |
|---|---|
| ***G01V 3/18*** | (2006.01) |
| ***G06F 17/10*** | (2006.01) |
| ***E21B 47/00*** | (2012.01) |

(52) U.S. Cl.

USPC ..... 702/12; 703/2; 324/339; 166/252.4; 73/152.39

(58) Field of Classification Search

USPC ..... 702/12, 11; 703/2, 10; 324/339, 324/346; 166/250.07, 252.4; 73/152.39, 73/152.41

See application file for complete search history.

(56) References Cited

U.S. PATENT DOCUMENTS

| | | | | |
|---|---|---|---|---|
| 5,970,787 | A | 10/1999 | Wignall | |
| 6,612,171 | B1 | 9/2003 | Stephenson et al. | |
| 7,656,160 | B2 * | 2/2010 | Legendre et al. | 324/339 |
| 7,784,539 | B2 * | 8/2010 | Montaron | 166/252.4 |
| 7,890,264 | B2 * | 2/2011 | Elphick | 702/12 |
| 8,191,416 | B2 * | 6/2012 | Kuchuk et al. | 73/152.41 |
| 2006/0020438 | A1 * | 1/2006 | Huh et al. | 703/10 |
| 2006/0153005 | A1 * | 7/2006 | Herwanger et al. | 367/38 |
| 2009/0164187 | A1 | 6/2009 | Habashy et al. | |

FOREIGN PATENT DOCUMENTS

WO 2007016389 A1 2/2007

OTHER PUBLICATIONS

International Search Report and Written Opinion of PCT Application Serial. No. PCT/US2010/045497 dated Apr. 22, 2011.

Darwin V. Ellis and Julian M. Singer, "Well Logging for Earth Scientists", Springer.

Clavier C., Coates G., Dumanoir J., "The Theoretical and Experimental Bases for Dual Water Model for the Interpretation of Shaly Sands", Paper SPE 6859, Oct. 1977.

John A. Veil and Maurice B. Dusseault, "Evaluation of Slurry Injection Technology for Management of Drilling Wastes", Argonne National Laboratory, Prepared for US Department of Energy, May 2003.

Richard G. Keck, "Drill Cuttings Injection: A Review of Major Operations and Technical Issues", Paper SPE 77553, Oct. 2002.

J.L Brady, D.S. Wolcott and C.L.V. Aiken, "Gravity Methods: Useful Techniques for Reservoir Surveillance", The Log Analyst, 1996.

* cited by examiner

*Primary Examiner* — Bryan Bui

(74) *Attorney, Agent, or Firm* — Jeremy Berman

(57) ABSTRACT

A method comprising: estimating a change in a characteristic of a subterranean formation into which a fluid has been injected via a well extending into the subterranean formation; building a multi-dimensional model balancing mass of the injected fluid, wherein the model is based on the estimated characteristic change; utilizing the model to determine the sensitivity of a borehole gravity tool in the well; measuring gravity with the borehole gravity tool at a plurality of stations along the well; and utilizing the model and the gravity measurements to locate the injected fluid in the subterranean formation.

20 Claims, 14 Drawing Sheets

FIG. 5A
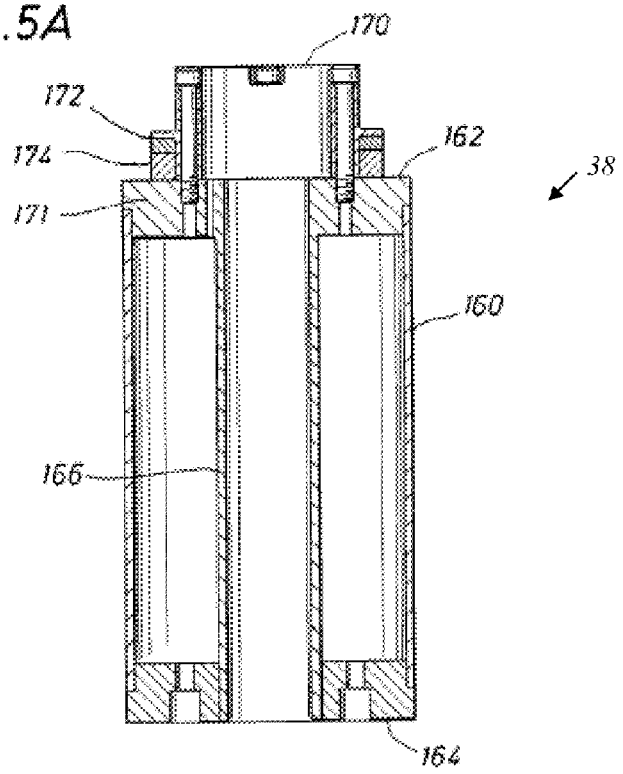
FIG. 5B
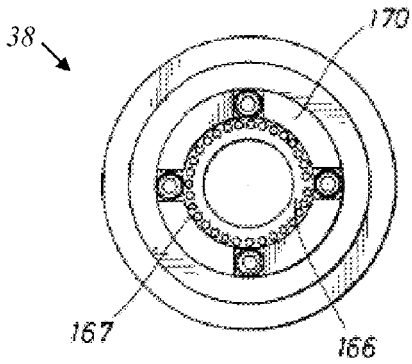
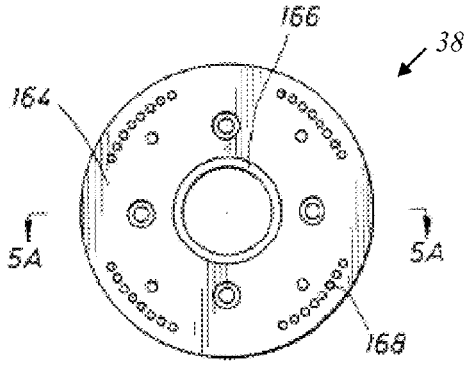
FIG. 5C

FIG. 7
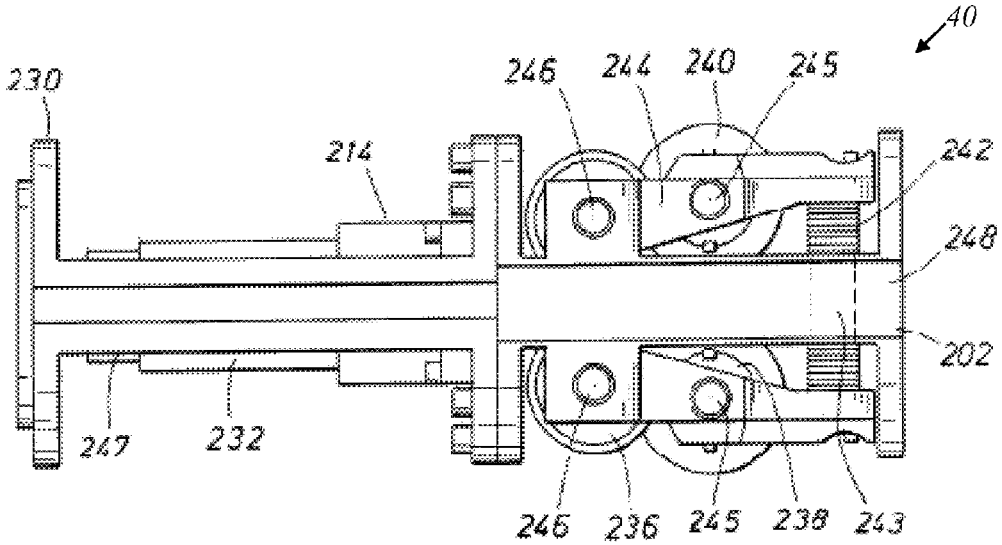
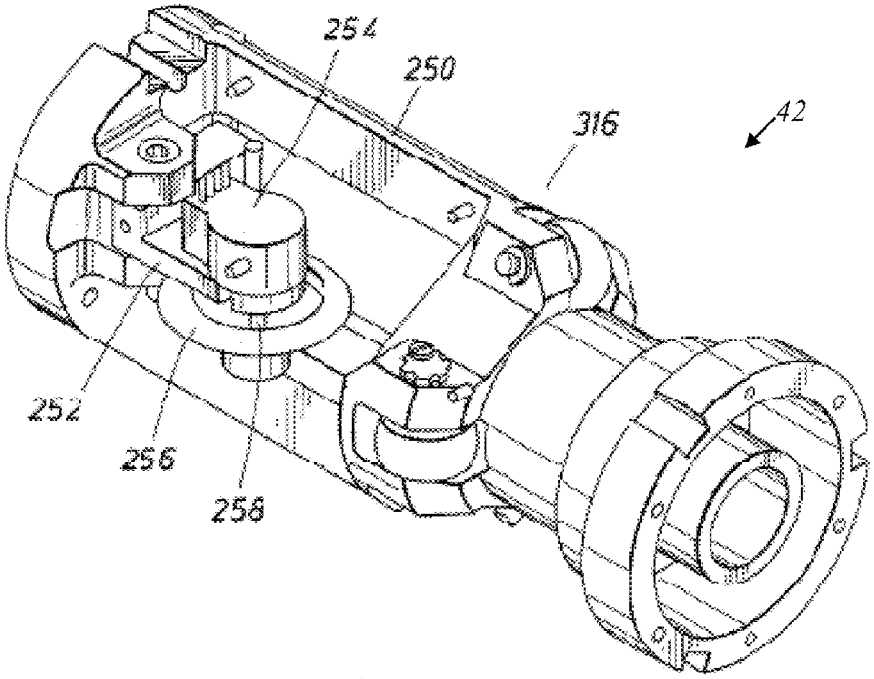
FIG. 8

GRAVITY INTERPRETATION WORKFLOW IN INJECTION WELLS

BACKGROUND OF THE DISCLOSURE

Grind and inject technology disposes of waste generated by oilfield operations. The goal is to decrease environmental impact and the overall footprint of new developments. Grind and inject technology entails crushing solid waste and adding water to make a slurry which is then injected into specially permitted disposal wells, where subsurface formations trap the injected slurries. However, the effect of such injection requires the reservoir to be monitored. That is, the injection is expected to change the reservoir density over time, both near the borehole and far from the borehole. In this context, there exists a need to monitor the displacement of mass in the subsurface and, in particular, indicate if the injected material is staying near the perforation zone or is taking advantage of a path induced by the injection, such that the slurry has moved vertically in the formation.

SUMMARY OF THE DISCLOSURE

One aspect is directed to a method that may include estimating a change in a characteristic of a subterranean formation into which a fluid has been injected via a well extending into the subterranean formation. The method may also include building a multi-dimensional model balancing mass of the injected fluid, wherein the model is based on the estimated characteristic change, and utilizing the model to determine the sensitivity of a borehole gravity tool in the well. The method may further include measuring gravity with the borehole gravity tool at a plurality of stations along the well, and utilizing the model and the gravity measurements to locate the injected fluid in the subterranean formation.

Another aspect is directed to a method that may include determining total porosity of a subterranean formation into which a fluid has been injected via a well extending into the subterranean formation, and estimating time-lapse variation of the porosity based on the total porosity, perforation data and injection data. The method may also include building a time-lapse density model based on the estimated time-lapse variation of the porosity, formation matrix density data and injected fluid density data, and projecting a borehole gravity tool response at a plurality of stations along the well based on the time-lapse density model.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIGS. 5A-5C are schematic views of apparatus according to one or more aspects of the present disclosure.

FIG. 7 is a schematic view of apparatus according to one or more aspects of the present disclosure.

FIG. 8 is a schematic view of apparatus according to one or more aspects of the present disclosure.

DETAILED DESCRIPTION

Figure 1:
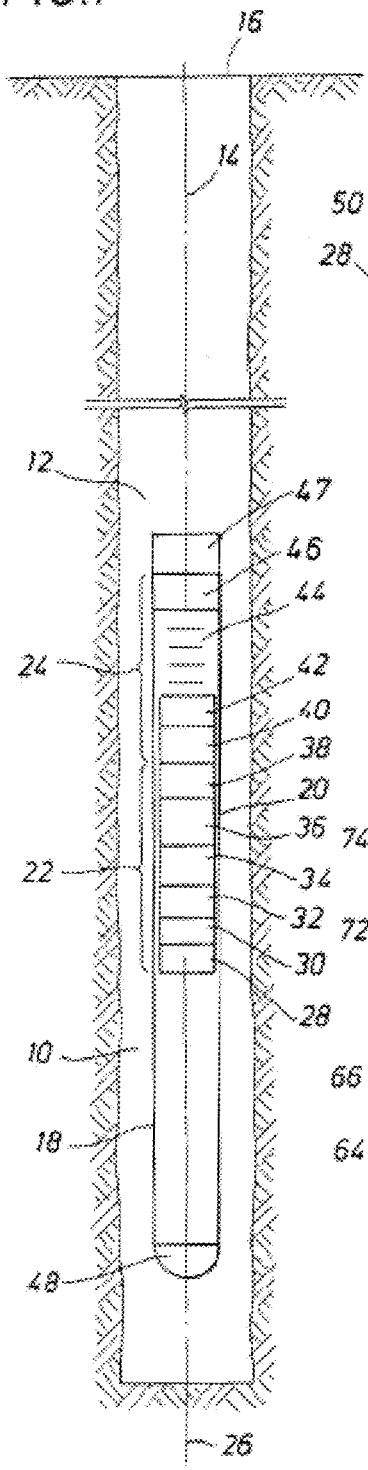
FIG. 1 is a schematic view of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Oil exploration involves evaluating reservoirs to determine the movement or absence of oil, gas, or water as the reservoir fluids are produced. Gas, oil and/or water movement in a reservoir can be monitored by gravity methods which include determination of the acceleration due to gravity (henceforth referred to as gravity for the sake of brevity) within a borehole and at the surface of the reservoir. Borehole gravity data may be used to map out the vertical distribution of gas, oil and/or water at a well, and surface gravity may be used to understand the horizontal distribution of gas, oil and/or water.

Borehole gravity surveys comprise measuring local earth gravity at a series of stations in a borehole. The difference in gravity ($\Delta g$) and the vertical distance ($\Delta z$) between two successive stations yield sufficient information to determine the bulk density of the strata adjacent the borehole. Bulk density includes the density of the rock matrix and the density of the gas or fluid filling the pore space. The bulk density is then mapped out to determine the vertical distribution of water, oil and/or gas as the reservoir fluids are produced.

Bulk density, $\rho$, is given by the following expression:

$$\rho=(F-\Delta g/\Delta z)/(4\pi G)$$

where $\Delta g/\Delta z$ is the vertical gradient of gravity between two spaced apart stations, F is the free air gravity, and G is the universal gravitational constant. The free air gravity, F, may be determined during borehole gravity surveys, so that the only unknown is the bulk density, ρ.

The further apart the station measurements are made, the further from the borehole in the horizontal plane is the zone of investigation. A five-foot interval may produce a radial zone of investigation of 0-5 feet from the borehole. The deeper zone of investigation may make it possible to determine the true gas-oil contact, free from borehole effects such as localized gas cone, mud, and casing.

Gravity measurements may be monitored in the microGal ($10^{-6}$ cm/s$^2$) range, which may ensure useable data that provide an indication of untapped pockets of oil or gas in the strata adjacent a borehole. This level of resolution in gravity measurements requires a highly precise gravity sensor and carefully implemented measuring techniques. For example, the gravity sensor may be oriented so that the sensitive axis of the sensor is vertically aligned. A deviation of the sensitive axis of the sensor by an angle α from the vertical corresponds to an error of $g\cdot(1-\cos\alpha)$, where g is the gravitational acceleration. Thus, a deviation by an angle α equal to 45 μrad (or 0.00258°) from the vertical would result in an error of about 1 microGal. In addition to keeping the sensitive axis of the gravity sensor aligned with the vertical during gravity measurements, the depth measurements of the stations may also be maintained accurate to within 1 mm, such that density may be obtained with accuracy of 0.01 g/cm$^3$.

FIG. 1 is a schematic view of a sonde 10 according to one or more aspects of the present disclosure. The sonde 10 is suspended in a borehole 12 on the end of a wireline 14 that is supported at the surface 16. The wireline 14 is used to lower and raise the sonde 10 within the borehole 12. The positioning of the sonde 10 in the borehole 12 is controlled from the surface 16. The borehole 12 may be cased, lined or open.

The sonde 10 includes an elongated, hollow, pressure vessel 18 configured to withstand the pressures, temperatures and fluids of the borehole environment. A gravity tool 20 disposed in the pressure vessel 18 comprises a rotatable portion 22 and a non-rotatable portion 24. The rotatable portion 22 may rotate about the longitudinal axis 26 of the pressure vessel 18. The rotatable portion 22 and the non-rotatable portion 24 are configured to travel simultaneously along the longitudinal axis 26 of the pressure vessel 18 to make gravity measurements.

The rotatable portion 22 comprises a gravity meter 28, a gimbal drive assembly 30, an electronic controller 32, an accelerometer assembly 34, a roll-axis drive 36 and a slip ring assembly 38. The gravity meter 28 comprises a gravity sensor configured to measure gravity at stations along the borehole. The gimbal drive assembly 30 and the roll-axis drive 36 are collectively configured to align the sensitive axis of the gravity sensor with the vertical before gravity measurements are taken at a measuring station.

The electronic controller 32 is configured to monitor operation of the gimbal drive assembly 30 and the roll-axis drive 36 and respond to signals from the accelerometer assembly 34. The signals from the accelerometer assembly 34 may be indicative of the inclination of the gravity tool 20 with respect to the vertical. The slip ring assembly 38 is configured to couple electrical signals between the rotatable portion 22 and the non-rotatable portion 24.

The non-rotatable portion 24 comprises an elevator mechanism 40, an optical encoder assembly 42 and a spring-loaded harness assembly 44. The elevator mechanism 40 is configured to translate the entire gravity tool 20 from one station to the next inside the pressure vessel 18. The optical encoder assembly 42 is configured to measure the displacement of the gravity meter 28 from one station to the next. The spring-loaded harness assembly 44 is configured to control the electrical wiring as the gravity tool 20 moves along the length of the pressure vessel 18.

The gravity tool 20 is attached to a head assembly 46 which comprises an interface (not shown) through which electrical power may be supplied to the gravity tool 20 from the surface 16. A nose assembly 48 serves as a shock absorber when the gravity tool 20 impacts the nose assembly 48.

Although FIG. 1 shows the sonde 10 and gravity tool 20 in a vertical borehole, it should be clear that one or more aspects of the present disclosure are not limited to a vertical borehole, and are applicable or readily adaptable to use in a deviated or horizontal borehole.

Figure 2:
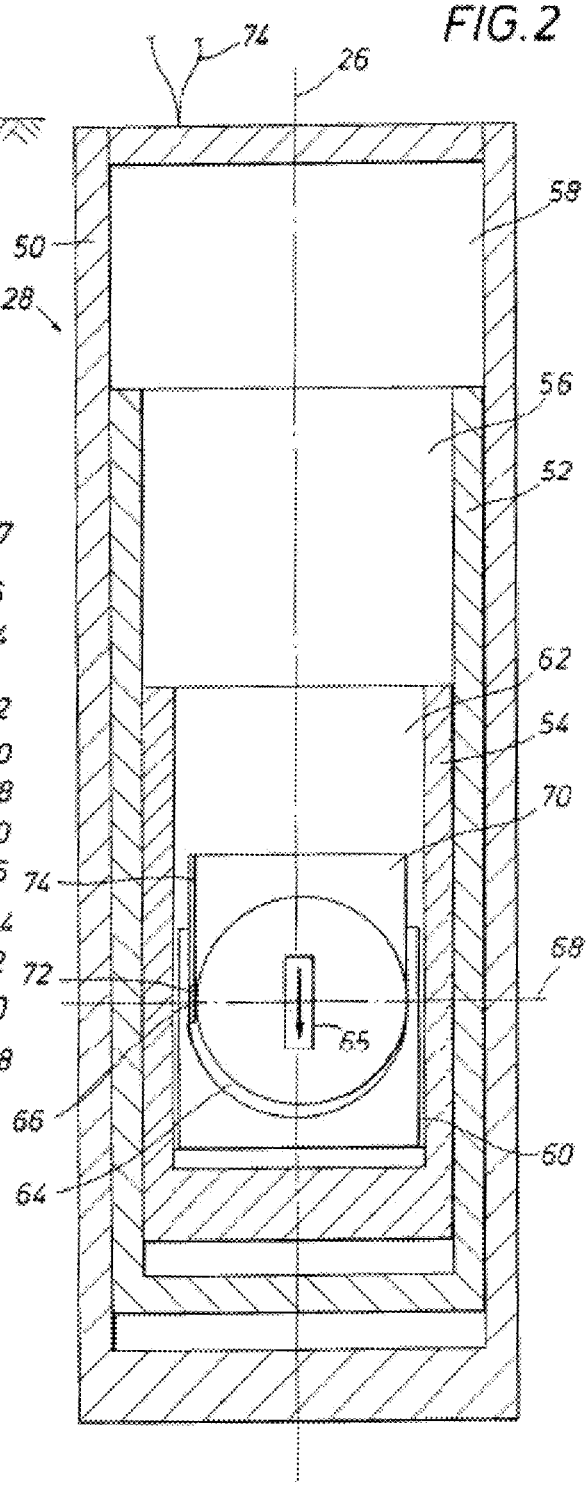
FIG. 2 is a schematic view of apparatus according to one or more aspects of the present disclosure.

FIG. 2 is a sectional view of a portion of the gravity tool 20 shown in FIG. 1. As shown in FIG. 2, the gravity meter 28 comprises an outer Dewar 50. A heater sleeve 52 disposed in the outer Dewar 50 is configured to slip over an inner Dewar 54 and an electronics board 56. An outer stopper 58 anchors the heater sleeve 52, the electronics board 56 and the inner Dewar 54 in the outer Dewar 50.

A sensor housing 60 is anchored in the inner Dewar 50 by an inner stopper 62. The sensor housing 60 may comprise a heater (not shown). A gimbal 64 supported on a gimbal shaft 66 is mounted for rotation inside the sensor housing 60. A pivot axis 68 of the gimbal 64 is displaced at an angle relative to the longitudinal axis 26 of the pressure vessel 18. The pivot axis 68 of the gimbal 64 may be orthogonal to the longitudinal axis 26 of the pressure vessel 18. A gravity sensor 65 configured to measure gravity is supported inside the gimbal 64.

The outer Dewar 50 and the inner Dewar 54 collectively define a temperature-stabilized chamber 70 for the gravity sensor 65. The temperature of the chamber 70 may be maintained at 25° C. above the highest ambient temperature rating in the borehole. The temperature may be controlled to 0.001° C. and may be modeled to $10^{-6}$° C. One or more heaters disposed in the sensor housing 60 and/or the heater sleeve 52 may be configured to compensate for small residual temperature changes in the chamber 70. The stopper 58 in the outer Dewar 50 and/or the stopper 62 in the inner Dewar 54 may also be heated and/or otherwise serve to prevent heat flow through the ends of the Dewars. The electronics board 56 adjacent the inner Dewar 54 may be configured to control any heaters incorporated in the gravity meter 28.

The heater sleeve 52 may comprise a magnetic shield configured to protect the gravity sensor 65 from magnetic fields in the borehole 12. Magnetic fields in the borehole 12 can create torque on the gravity sensor which may result in errors in gravity measurements. However, embodiments within the scope of the present disclosure are not limited to those in which the heater sleeve 52 comprises the magnetic shield. For example, a magnetic shield may alternatively or additionally be located with the sensor housing 60, the outer Dewar 50 and/or the inner Dewar 54.

The gimbal shaft 66 supports a pulley 72. A gimbal cable 74 is wound on the pulley 72 with the free ends of the gimbal cable 74 extending through the sensor housing 60 to the exterior of the gravity meter 28. During operation of the gravity tool 20, the free ends of the gimbal cable 74 are linked to the gimbal drive assembly 30. The gimbal drive assembly 30 is configured to extend or retract the free ends of the gimbal cable 74 to cause the gimbal 64 to be rotated about its pivot axis 68 through a predetermined angle and in a predetermined direction. The diameter of gimbal cable 74 may be very small or otherwise configured to minimize heat loss and transfer between Dewars 50 and 54 and the environment.

Figure 3A:
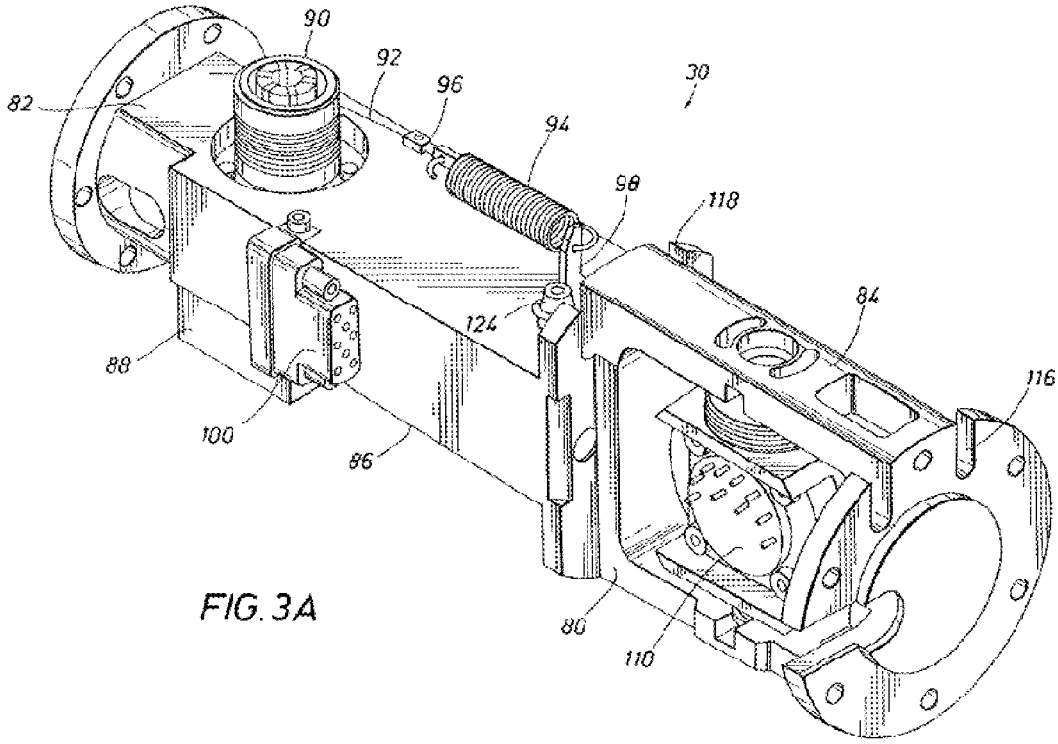
FIGS. 3A and 3B are schematic views of apparatus according to one or more aspects of the present disclosure.
Figure 3B:
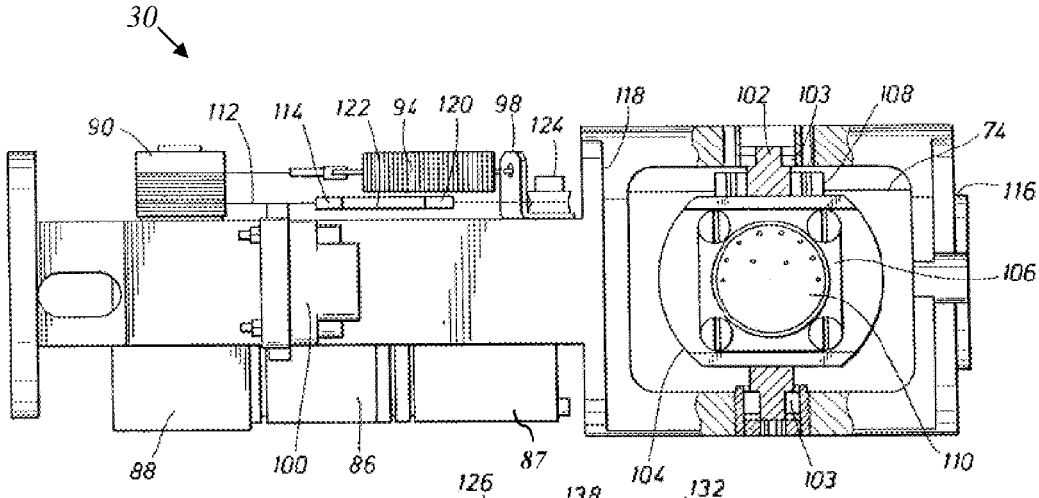

FIGS. 3A and 3B are schematic views of the gimbal drive assembly 30 shown in FIG. 2. Referring to FIGS. 2, 3A and 3B, respectively, the gimbal drive assembly 30 comprises a gimbal drive frame 80. The gimbal drive frame 80 comprises an upper portion 82 and a lower portion 84. A reducing gear box 86, stepper motor 87, right-angle gear box 88 and bobbin 90 are coupled to the upper portion 82 of the gimbal drive frame 80. The drive shaft of the stepper motor 87 is coupled to the gear box 88 which drives the bobbin 90. The free end of a backlash cable 92 wound on the bobbin 90 is attached to a spring 94 by a turnbuckle 96. The spring 94 is coupled to a bracket 98 that is coupled to the gimbal drive frame 80. The spring 94 is configured to eliminate backlash when the stepper motor 87 is stopped or reversed. A connector 100 coupled to the upper portion 82 of the gimbal drive frame 80 is configured to allow power to be supplied to the stepper motor 87.

A shaft 102 is rotatably coupled to the lower portion 84 of the gimbal drive frame 80 via a pair of ball bearings 103. A sensor ring 104 which supports a sensor mounting ring 106 is coupled to the shaft 102. A sensor adjuster ring stop 108 is supported on the shaft 102 and coupled to the top of the sensor mounting ring 106 so that the sensor adjuster ring stop 108 and the sensor mounting ring 106 can rotate together.

An angular tilt sensor 110 is coupled to the sensor mounting ring 106. The angular tilt sensor 110 may be or comprise a uniaxial accelerometer configured to provide an error signal indicating departure of the sensitive axis of the gravity sensor 65 from the vertical. When the sensitive axis of the gravity sensor 65 is aligned with the vertical, the angular tilt sensor 110 is level and the output voltage of the tilt sensor is equal to $V_{offset}$. As the pressure vessel 18 traverses a deviated borehole, the output voltage of the tilt sensor becomes $V_{offset}+V_{tilt}$, where $V_{tilt}$ is proportional to the tilt angle of the sensitive axis of the gravity sensor 65 with respect to a fixed reference. The angular tilt sensor 110 uses the Earth's gravitational field as a reference.

In operation, a drive cable 112 is wound on the bobbin 90. The free ends of the drive cable 112 are attached to turnbuckles 114. The free ends of the gimbal cable 74 from the gravity meter 28 pass through a first set of slots 116 in the lower portion 84 of the gimbal drive frame 80 and a second set of slots 118 in the upper portion 82 of the gimbal drive frame 80 to attach to turnbuckles 120. The turnbuckles 120 are linked to turnbuckles 114 by connectors 122. A portion of one of the free ends of the gimbal cable 74 is wound once around the sensor adjuster ring stop 108 to allow the angular tilt sensor 110 and the gimbal 64 in the gravity meter 28 to rotate concurrently. The drive cable 112 and the gimbal cable 74 are appropriately tensioned to eliminate backlash in the cable system when the stepper motor 87 is stopped or reversed. A bushing idler 124 ensures that the cables 74 and 112 follow a straight course as they extend and retract. In an alternative embodiment, cable 92, spring 94, turnbuckle 96, bracket 98 and idler 124 may be omitted.

Signals from the angular tilt sensor 110 are sent to the electronic controller 32. The electronic controller 32 uses these signals to determine if the gimbal drive assembly 30 should be operated to drive the gimbal 64 to maintain the vertical orientation of the gravity sensor 65. The electronic controller 32 may send an electrical pulse to the stepper motor 87 to cause the drive shaft of the stepper motor 87 to rotate through a predetermined fixed angle. As the drive shaft of the stepper motor 87 rotates, the drive cable 112 winds on or unwinds from the bobbin 90. The movement of the drive cable 112 is transmitted to the gimbal cable 74, causing the gimbal 64 and the angular tilt sensor 110 to rotate about their respective pivot axes. The angular tilt sensor 110 and the gimbal 64 can rotate a full 360° about their pivot axes, if necessary. As the gimbal 64 and the angular tilt sensor 110 rotate, feedback signals are sent to the electronic controller 32 by the angular tilt sensor 110. When the angular tilt sensor 110 sends a signal that indicates that the angular tilt sensor 110 is level, the electronic controller 32 stops the stepper motor 87. The electronic controller 32 and the gimbal drive assembly 30 are collectively configured to maintain the gravity sensor vertical to within 48.5 μrad (or 0.00278°).

As described above, the gimbal drive assembly 30 is configured to rotate the gimbal 64 about the pivot axis 68. However, other mechanisms, such as push rods, rack and pinion, and gear sets, may also be used to rotate the gimbal 64 within the scope of the present disclosure. The gravity sensor 65 may also be provided with a built-in tilt meter which may be controlled to align the sensitive axis of the gravity sensor with vertical; however, the typical range of a built-in tilt meter is of the order of 4.85 mrad (or 0.278°). The range of the angular tilt sensor 110 which tracks the position of the gravity sensor 65 with respect to vertical may be 360°, which may enable the gimbal 64 to effectively align the sensitive axis of the gravity sensor 65 in any deviated or horizontal borehole. Also, the present disclosure is equally applicable or readily adaptable to applications where a sensor may need to be at any predetermined angle to vertical since the angular tilt sensor may be arranged to give continuous feedback signals indicative of the departure of the sensor from vertical.

Figure 4:
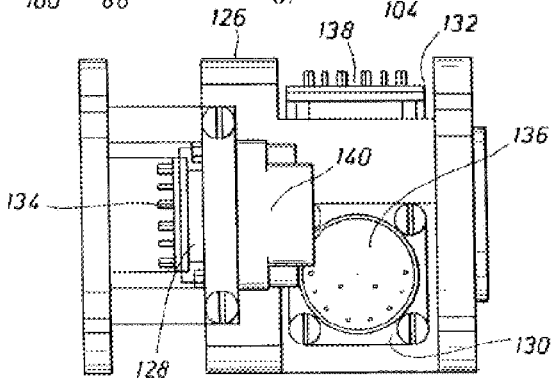
FIG. 4 is a schematic view of apparatus according to one or more aspects of the present disclosure.

FIG. 4 is a schematic view of the accelerometer assembly 34 shown in FIG. 1. The accelerometer assembly 34 comprises a sensor frame 126 to which a first sensor ring 128, a second sensor ring 130 and a third sensor ring 132 are coupled. Single-axis accelerometers 134, 136 and 138 are coupled to the sensor rings 128, 130 and 132, respectively. The sensitive axes of the three accelerometers 134, 136 and 138 may be orthogonal to each other, and the sensitive axis of the accelerometer 134 may be coincident with the longitudinal axis 26 of the pressure vessel 18. The accelerometers 134, 136 and 138 are configured to measure instantaneous acceleration along their corresponding sensitive axes. This information is sent to the electronic controller 32 to, for example, determine the pitch and roll inclinations of the gravity tool 20. A power distribution board (not shown) may be mounted inside the sensor frame 126 to distribute power to the accelerometer assembly 34 and the electronic controller 32.

FIGS. 5A-5C are schematic views of the slip ring assembly 38 shown in FIG. 1. Referring to FIGS. 5A-5C, collectively, the slip ring assembly 38 may be or comprise a multi-conductor slip ring/brush block assembly, which may comprise a slip ring housing 160 comprising an upper end 162 and a lower end 164. A tube 166 inside the slip ring housing 160 is arranged to receive a shaft. The upper end of the tube 166 is provided with a plurality of apertures 167. The lower end 164 of the slip ring housing 160 is provided with a plurality of apertures 168. Electrical wires extending through the slip ring housing exit through the apertures 167 and 168 at the upper and lower ends 162 and 164 of the slip ring housing 160, respectively. Ball bearings (not shown), such as may be disposed between the slip ring housing 160 and the tube 166, may support the slip ring housing 160 for rotation about the tube 166. Rotors, stators, brushes and slip rings (all of which are not shown) that conduct electrical signals in the slip ring assembly 38 may be located between the walls of the tube 166 and the slip ring housing 160. A sleeve 170 is bolted to the upper end 171 of the tube 166. Wave springs 172 and a Teflon washer 174 positioned between the sleeve 170 and the tube 166 may prevent backlash when the roll-axis drive 36 driving the rotatable portion 22 of the gravity tool 20 is stopped.

Figure 6:
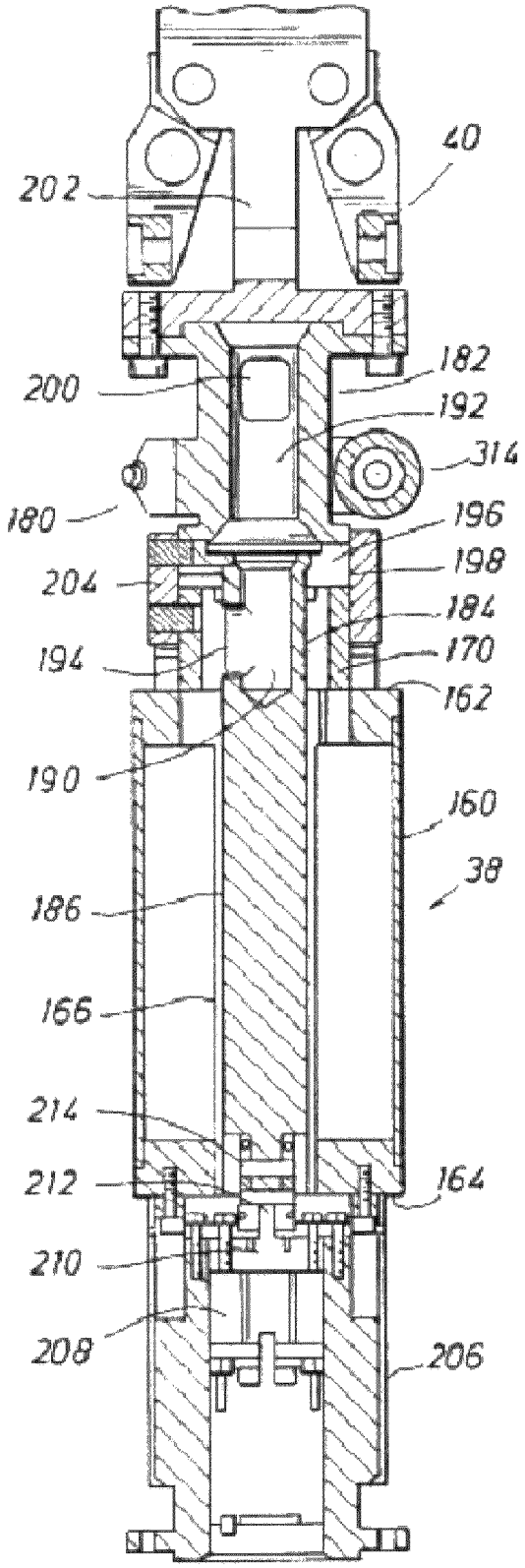
FIG. 6 is a schematic view of apparatus according to one or more aspects of the present disclosure.

FIG. 6 is a schematic view of a portion of the gravity tool shown in FIG. 1, including the slip ring assembly 38 and the elevator mechanism 40. A coupling assembly 180 which couples the slip ring assembly 38 to the elevator mechanism 40 is at the upper end 162 of the slip ring housing 160. The coupling assembly 190 comprises an upper portion 182 and a lower portion 184. The lower portion 184 comprises a shaft 186 which mates with the tube 166 in the slip ring housing 160. The shaft 186 comprises an internal bore 190 configured to receive electrical wires from the slip ring assembly 38. The bore 190 communicates with a channel 192 in the upper portion 182 of the coupling assembly 180. Electrical wires extending out of apertures 167 in the upper end of the tube 166 (see FIG. 5B) enter the channel 192 through a slot 194 which communicates with the bore 190 and slots 196 which are circumferentially arranged about the portion 198 of the coupling assembly 180. The wires in the channel 192 extend out of slots 200 in the upper portion of the coupling assembly 180 and are received in channels 202 in the elevator mechanism 40. The coupling assembly 180 is coupled to the sleeve 170 that is bolted to the tube 166 by a pair of circular plates 204.

A motor mount 206 which houses the roll-axis drive 36 is coupled to the lower end 164 of the slip ring housing 160. The roll-axis drive 36 comprises a stepper motor 208 which drives a transmission system 210. The transmission shaft 212 of the transmission system 210 is coupled to the shaft 186 of the coupling assembly 180 by a shaft coupling 214.

In operation, electrical pulses are sent to the stepper motor 208 of the roll-axis drive 36, causing the drive shaft of the stepper motor 208 to rotate through a predetermined angle. The drive shaft of the stepper motor 208 in turn drives the transmission system 210. The transmission shaft 212 attempts to rotate the shaft 186 of the coupling assembly 180. However, the coupling assembly 180 is coupled to the non-rotatable portion 24 of the gravity tool 20 so that the shaft 186 of the coupling assembly 180 does not rotate. Instead, the resultant torque generated between the driven transmission shaft 212 and the shaft 186 of the coupling assembly 180 causes the motor mount 206 which supports the transmission shaft 212 to rotate. As the motor mount 206 rotates, the slip ring housing 160 coupled to the motor mount 206 also rotates, as does the accelerometer assembly 34, the electronic controller 32, the gimbal drive assembly 30 and the gravity meter 28. The tube 166 does not rotate with the slip ring housing 160.

FIG. 7 is a schematic view of the elevator mechanism 40 shown in FIG. 1. The elevator mechanism 40 comprises a motor 232 coupled within an elevator housing 230. The motor 232 may be or comprise a brushless DC motor and/or a stepper motor. The drive shaft of the motor 232 is coupled to a reduction gear box 214 that drives a pair of worm gears 236. Each worm gear 236 drives a spur gear 238. A wheel 240 on each spur gear 238 is configured to contact the inside surface of the pressure vessel 18. When the spur gears 238 are driven, the wheels 240 ride up and down along the length of the pressure vessel 18.

The wheels 240 are preloaded against the wall of the pressure vessel 18 using Belleville springs 242. The Belleville springs 242 are supported on a rod 243. Levers 244 on the ends of the rod 243 are connected to the shafts 245 of the spur gears 238 and to the shafts 246 of the worm gears 236. This arrangement allows the springs 242 to exert force on the levers 244 to push the wheels 240 against the inside diameter of the pressure vessel 18. The force applied to the wall of the pressure vessel 18 by the springs 242 is sufficient to provide traction to lift the weight of the gravity tool 20 when the gravity tool 20 is in the vertical position.

The motor 232 may be provided with a brake 247 configured to prevent the motor 232 from turning when it is on station. The worm gears 236 may also function as a brake if a gear pitch is selected that does not back-drive when the gravity tool 20 is vertical. The channels 202 on the sides of the elevator housing 230 receive electrical wires from the coupling assembly 180 (shown in FIG. 6).

While the illustrated embodiment shows the elevator mechanism 40 as being linked to the gravity meter 28 so as to move the gravity meter 28 inside the pressure vessel 18, it should be clear that the scope of the present disclosure is not limited to embodiments using the elevator mechanism 40 to move the gravity meter 28 inside the vessel 18. For example, in another embodiment within the scope of the present disclosure, the elevator mechanism 40 may be sealed within an oil-filled enclosure and mounted external to the pressure vessel 18 and the gravity meter 28 can be held at a fixed position inside the vessel 18. The externally mounted elevator mechanism would then support and translate the pressure vessel along the length of the borehole to make gravity measurements. This may provide a greater depth of investigation, since the gravity sensor could be moved to stations beyond that achievable inside the pressure vessel.

A conveyance mechanism, such as a cable supported on pulleys or a rotatable winch at the surface, may also or alternatively be used to move the pressure vessel along the length of the borehole instead of or in addition to the elevator mechanism. The pressure vessel may be quickly lowered into the borehole by the aid of a casing collar locator 47 (shown in FIG. 1) which may be mounted on the pressure vessel. The casing collar locator, which may be or comprise an electromagnetic pickup or acoustic transducer or mechanical feeler gauge, may be configured to find casing collars that are located at known depths inside the borehole. Once the casing collars are located, the measuring stations can be accurately located to within 1 mm or 2 mm. Also, the elevator mechanism may be used inside the pressure vessel to move the gravity sensor along the length of the pressure vessel while a conveyance mechanism is used to move the pressure vessel along the length of the borehole.

FIG. 8 is a schematic view of the optical encoder assembly 42 shown in FIG. 1. The optical encoder assembly comprises a mounting frame 250. A lever 252 is spring mounted on the mounting frame 250. The lever 252 supports an optical encoder 254. An encoder wheel 256 is connected to the optical encoder 254 by a shaft 258. The encoder wheel 256 may be made of a material that does not change dimensions with temperature, which may eliminate the need for temperature correction on the measured displacement. For example, the encoder wheel 256 may comprise invar. As the wheel 256 rotates, the shaft 258 also rotates. The optical encoder 254 delivers electrical pulses which are proportional to the speed of the shaft 258 at its output terminal. A connector 260 is mounted inside the mounting frame 250 for connecting electrical wires from the elevator mechanism 40 to the optical encoder assembly 42. An electronics board (not shown) may also be provided to record readings from the optical encoder 254.

Several other means exist for measuring the displacement of the gravity meter inside the pressure vessel within the scope of the present disclosure. For example, if a stepper motor is used in the elevator mechanism 40, the steps required to move from one station to the next may be counted and translated to displacement. Alternatively, or additionally, a magnetic or optical pickup may measure the rotation of the worm gear or spur gear of the elevator mechanism 40 as the elevator mechanism moves the gravity tool 20. An electrical encoder can also be used in place of or in addition to an optical encoder.

Figure 9:
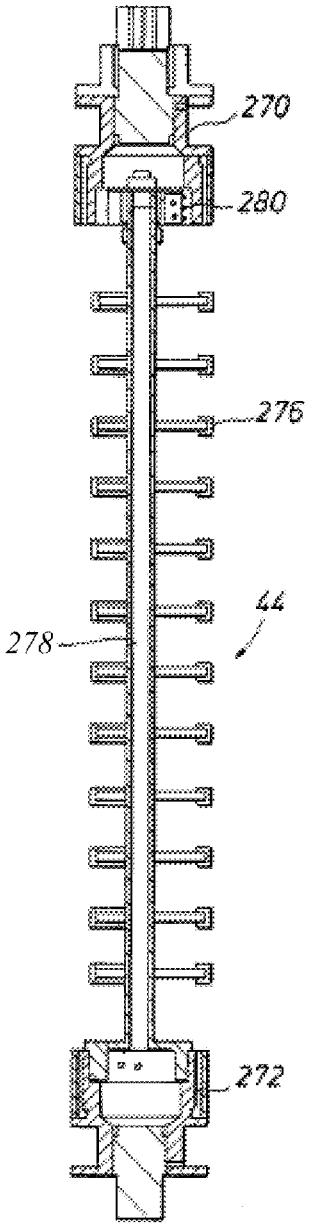
FIG. 9 is a schematic view of apparatus according to one or more aspects of the present disclosure.

FIG. 9 is a schematic view of the harness assembly 44 shown in FIG. 1. The harness assembly 44 comprises an upper portion 270 and a lower portion 272 which are linked by a flexible helical spring (not shown). Supports 276 may be inserted in the helical spring at spaced intervals along the length of the helical spring to keep the helical spring from vibrating during gravity measurement. The spring rate of the helical spring may be configured such that the elevator mechanism 40 does not have to support the weight of the harness assembly 44 when the helical spring is fully extended.

A rod 278 attached to the lower portion 272 moves with the elevator mechanism 40 inside the channel created by the coils of the helical spring as the elevator mechanism 40 translates the gravity meter 28 from one station to the next inside the pressure vessel 18. The rod 278 is arranged to contact a limit switch 280 in the upper portion 270 of the harness assembly 44 when the gravity meter 28 has reached the maximum upper limit or home position.

A cable containing insulated electrical wires runs from the upper portion 270 to the lower portion 272. The cable may be pre-coiled such that it fits inside the channel created by the coils of the helical spring and over the rod 278. The cable is configured to stretch or recoil as the gravity meter 28 is translated inside the pressure vessel 18.

The overall design of the gravity tool may allow the diameter of the tool to be fairly small, perhaps about 3⅜", and possibly scalable to 1 11/16", although other sizes are also within the scope of the present disclosure. An embodiment of the assembled gravity tool 20 is shown in sequential segments in FIGS. 10A-10D, although other embodiments are also within the scope of the present disclosure.

Figure 10A:
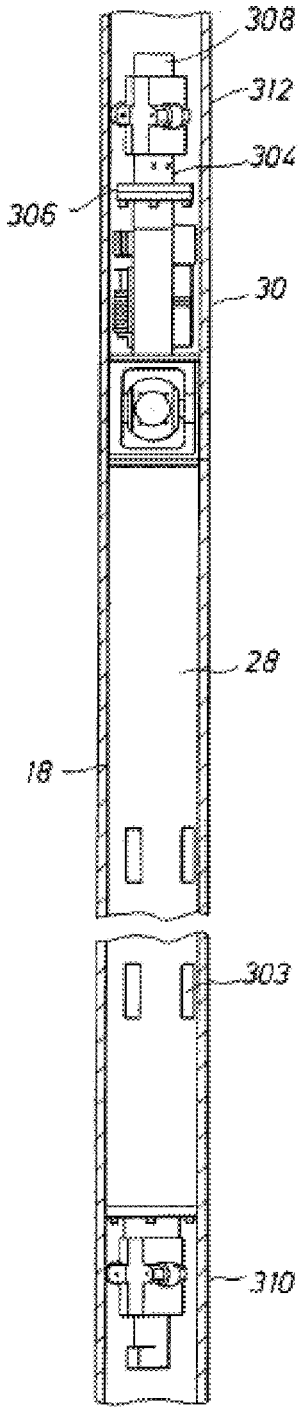
FIGS. 10A-10D are schematic views of apparatus according to one or more aspects of the present disclosure.

As shown in FIG. 10A, the gravity meter 28 is at the downhole end of the gravity tool 20. Teflon pads 303 are provided on the gravity meter 28 to space the surface of the gravity meter 28 from the inner surface of the pressure vessel 18. Coupled to one end of the gravity meter 28 is the gimbal drive assembly 30 which aligns the gravity sensor in the gravity meter 28 with the vertical. The gimbal drive assembly 30 is coupled to the electronic controller 32 by a coupling assembly 304. The coupling assembly 304 has a flange portion 306 and a shaft portion 308. The flange portion 306 is coupled to the gimbal drive assembly 30 and the shaft portion 308 is coupled to the mounting bracket 309 of the electronic controller 32.

Figure 10B:
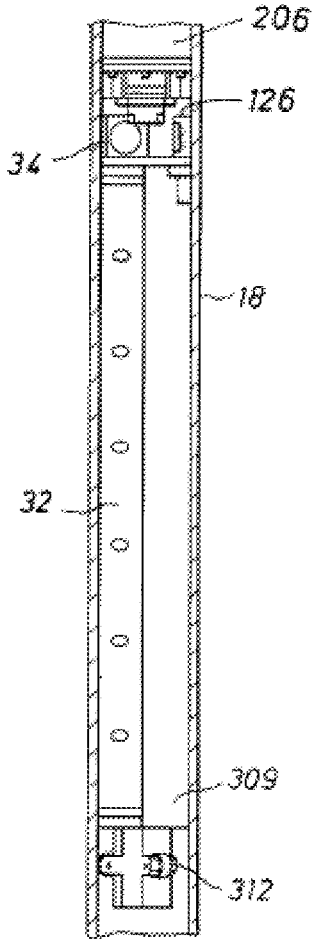
Figure 10C:
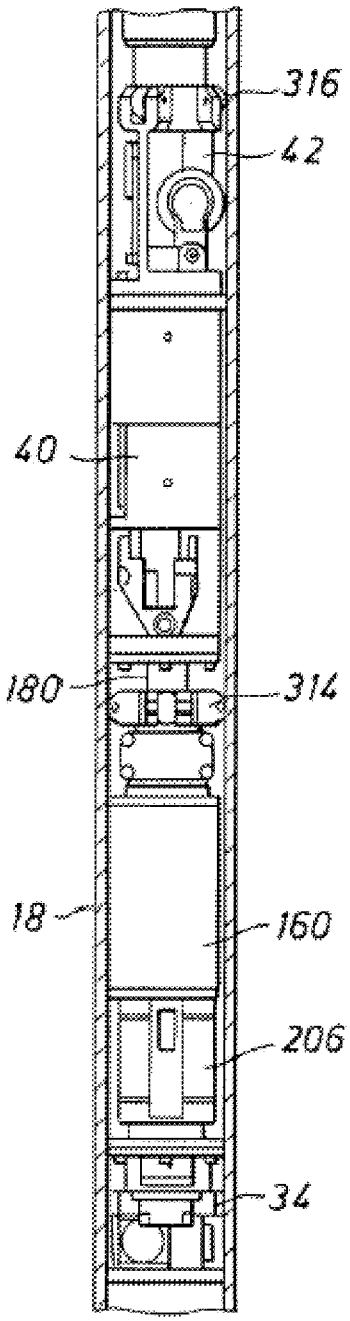
Figure 10D:
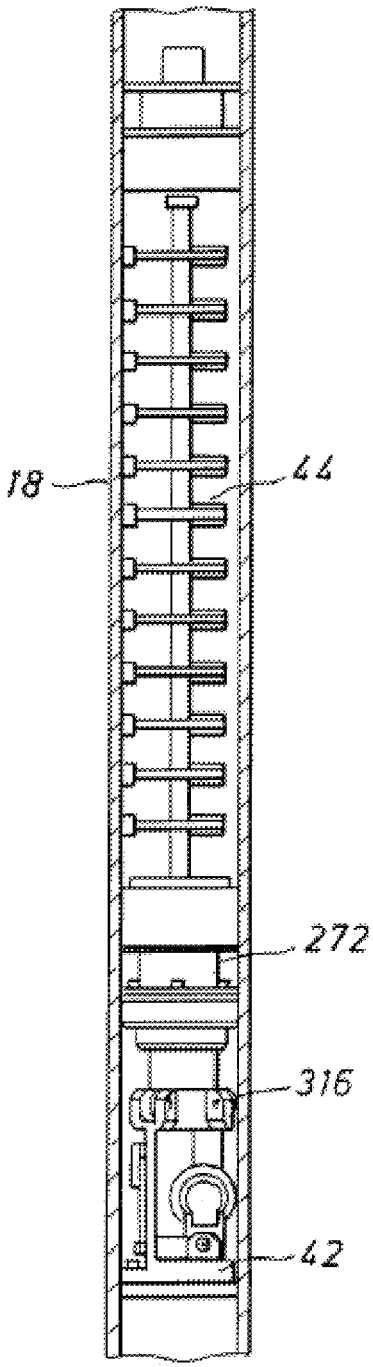

As shown in FIG. 10B, the mounting bracket 309 of the electronic controller 32 is coupled to the sensor frame 126 of the accelerometer assembly 34. The sensor frame 126 is coupled to the motor mount 206 which houses the roll-axis drive 36. As shown in FIG. 10C, the motor mount 206 is coupled to the slip ring housing 160 of the slip ring assembly 38. The stationary tube 166 (shown in FIG. 5A) in the slip ring housing is coupled to the elevator mechanism 40 by the coupling assembly 180. The optical encoder assembly 42 is coupled to the elevator mechanism 40. As shown in FIG. 10D, the optical encoder assembly 42 is coupled to the lower portion 272 of the spring-loaded harness assembly 44.

Roller assemblies 310, 312, 314 and 316 are configured to center the gravity tool 20 inside the pressure vessel 18. Roller assemblies 310 and 312 support the gravity assembly 28, gimbal drive assembly 30 and electronic controller 32 and permit axial and rotational movement of the rotatable portion 22 of the gravity tool 20 in the pressure vessel 18. Roller assemblies 314 and 316 support the non-rotatable portion 24 of the gravity tool 20 and permit axial movement in the pressure vessel 18.

Figure 11:
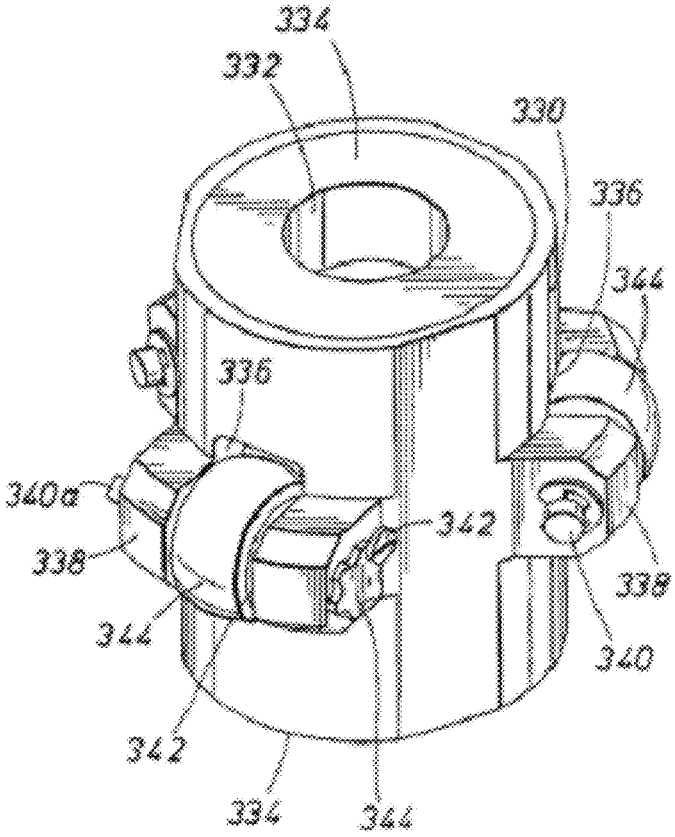
FIG. 11 is a schematic view of apparatus according to one or more aspects of the present disclosure.

FIG. 11 is a schematic view of the roller assembly 310 (also roller assembly 312) that supports the gimbal drive assembly 30 and the gravity meter 28 for rotation about the longitudinal axis 26 of the pressure vessel 18. The roller assembly 310 comprises a body 330 which is provided with an internal bore 332. Ball bearings 334 inside the bore 332 support the shaft portion 308 of the coupling assembly 304 (shown in FIG. 10A).

Three slots 336 in the wall of the body 330 are spaced 120° apart along the circumference of the body 330. Mounting blocks 338 on either side of the slots 336 project outwardly from the wall of the body 330. The mounting blocks 338 may be integrally formed with the body 330. The mounting blocks 338 comprise bores for receiving the ends of axles 340. Each axle 340 is supported on preloaded ball bearings 342 that are fixed to a side of the mounting blocks 338. The axles 340 may be stiff bow springs to help eliminate radial play.

A roller 344 is mounted on each axle 340. The rollers 344 fit into the slots 336 in the wall of the body 330, and are configured to ride along the wall of the pressure vessel in a direction parallel to the longitudinal axis of the pressure vessel.

One of the axles 340*a* is eccentrically mounted on its supporting bearing to allow for tight fitting of the roller assembly 310 with the inside diameter of the pressure vessel 18. The position of the eccentrically mounted axle 340*a* may be adjusted by loosening the screw 342 which locks a sprocket 344 in place on the side of one of the mounting blocks. When the screw 342 is loosened, the axle 340*a* can be adjusted so that the rollers 344 fit tightly with the inside diameter of the pressure vessel 18.

The roller assemblies 314 and 316 are similar to the roller assemblies 310 and 312, except that their bores are not lined with bearings and the roller assembly bodies are fixedly attached to the coupling assembly 180 and the optical encoder assembly 42, respectively. As such, the coupling assembly 180 and optical encoder assembly 42 do not rotate when the roll-axis drive 36 turns the rotatable portion of the gravity tool 20.

In operation, the sonde 10 is lowered into the borehole 12 on the end of a wireline 14. As the sonde 10 is lowered, the electronic controller 32 is continually receiving signals from the angular tilt sensor and the sensor assembly and using the gimbal drive assembly 30 and the roll axis drive 36 to align the gravity sensor with the vertical.

In conducting gravimetric surveys, the sonde 10 is lowered to a certain desired depth in the borehole on a wireline. The sonde 10 is then clamped to the borehole by a suitable clamping mechanism. The clamping mechanism ensures that the gravity sensor 65 is stable when gravity readings are taken. After the sonde 10 is secured to the borehole, the elevator mechanism 40 translates the gravity tool 20 inside the pressure vessel 18 until the gravity sensor 65 is aligned with a station. At the same time, the optical encoder 42 records the distance moved by the gravity tool 20.

At the measuring station, the accelerometers in the accelerometer assembly 34 measure instantaneous acceleration in three orthogonal directions. The electronic controller 32 uses the instantaneous accelerations from the accelerometers to determine the pitch and roll angles of the gravity tool 20 from a fixed reference. Based on the roll angle, the electronic controller 32 energizes the stepper motor of the roll-axis drive 36 to incrementally rotate the gravity tool 20 about an axis coincident with the longitudinal axis 26 of the pressure vessel 18. Also, based on the pitch angle, the electronic controller 32 energizes the stepper motor of the gimbal drive assembly 30 to incrementally rotate the bobbin 90 which in turn rotates the angular tilt sensor 110 and the gimbal 64. As the electronic controller 32 controls the roll-axis drive 36 and the gimbal drive assembly 30 to align the sensitive axis of the gravity sensor 65 with the vertical, the angular tilt sensor 110 sends signals indicative of the magnitude of departure of the sensitive axis of the gravity sensor 65 with respect to the vertical.

When the angular tilt sensor 110 indicates that the sensitive axis of the gravity sensor 65 is aligned with the vertical, the electronic controller 32 stops the gimbal drive assembly 30 and the roll-axis drive 36. The electronic controller 32 may send a signal to the surface to indicate that the gravity sensor 65 is aligned with the vertical. The gravity sensor 65 may then be activated from the surface or otherwise to measure gravity. After measuring gravity, the elevator mechanism 40 moves the gravity tool 20 inside the pressure vessel 18 again until the gravity sensor 65 is aligned with the next measuring station. The optical encoder assembly 42 monitors the position of the gravity sensor 65 as the gravity sensor 65 moves inside the pressure vessel 18. Again, the electronic controller 32 ensures that the sensitive axis of the gravity sensor 65 is aligned with the vertical before gravity readings are taken. The process of translating the gravity tool 20 inside the pressure vessel 18, aligning the sensitive axis of the gravity sensor 65 with the vertical, and activating the gravity sensor to measure gravity may continue until the gravity tool 20 touches the nose assembly 48. The distance between successive measuring stations in the pressure vessel may be about 1 m or more.

Other embodiments of the gravity tool 20 are also within the scope of the present disclosure. In one such example, the rotatable portion 22 of the gravity tool 20 may be extended to include the spring loaded harness assembly 44 so that the slip ring assembly 38 is not necessary to couple signals between the rotatable portion 22 and the non-rotatable portion 24 of the gravity tool 20.

The interpretation workflow described below presents a methodology to create, under specific conditions, three-dimensional ("3D") time-lapse density models used to forward model the response of the gravity tool 20 in a grind and inject well. These models may be built based on initial porosity logs, injection history and on perforation zone location. Each model represents the density change during a time interval due to a given mass of slurry injected into the subsurface at a certain depth interval. This workflow is applicable or readily adaptable to applications where another fluid is injected in the subsurface, such as with water injection. For example, such models may be built based on initial porosity logs, injection history, perforation zone location and an estimation of the initial water saturation along the well.

As used herein, "3D" may include models varying in each of three dimensions, such as along each of the x, y and z axes of a Cartesian system. For example, such models may utilize cells or other elements which have or represent height, width and depth. Other models, however, are also within the scope of the present disclosure. For example, other 3D models may be based on a cylindrical coordinate system. 3D models may also include those which vary in two dimensions but be considered to have a constant value in a third dimension. For example, in one such model based on a cylindrical coordinate system, cells or other elements of these models may be defined by axial position along the wellbore, angular orientation within the wellbore (e.g., azimuth), and radial distance from the wellbore, wherein the data may be assumed to be constant at all angular orientations (e.g., the data does not vary dependently upon azimuth). Such an example may be referred to in the industry as "2½D". For the sake of brevity, however, all of these systems may be referred to herein as "multi-dimensional."

The inputs may comprise one or more well deviation surveys, one or more neutron and/or density porosity logs at an initial time $T_0$ before slurry injection, injection history (e.g., mass injected per year), and the zone of injection in the well. The workflow generally comprises two steps: estimation of the change in porosity along the well over time, due to slurry injection; and building of a multi-dimensional time-lapse density model, respecting the total mass injected each year and using the estimation of the time-lapse porosity variation to compute an approximate time-lapse density variation.

In the following description of the estimate of time-lapse variation of porosity near a grind and inject well, it is supposed that the formation crossed by the well is shaly sand composed of a succession of sand and shale zones. A petrophysical interpretation based on a dual water model allows computation along the well of the volume of sand, the volume of dry clay and the total porosity. The sum of these three quantities is equal to 1. Based on these quantities, the time-lapse change of porosity due to an injection of slurry can be estimated.

Figure 12:
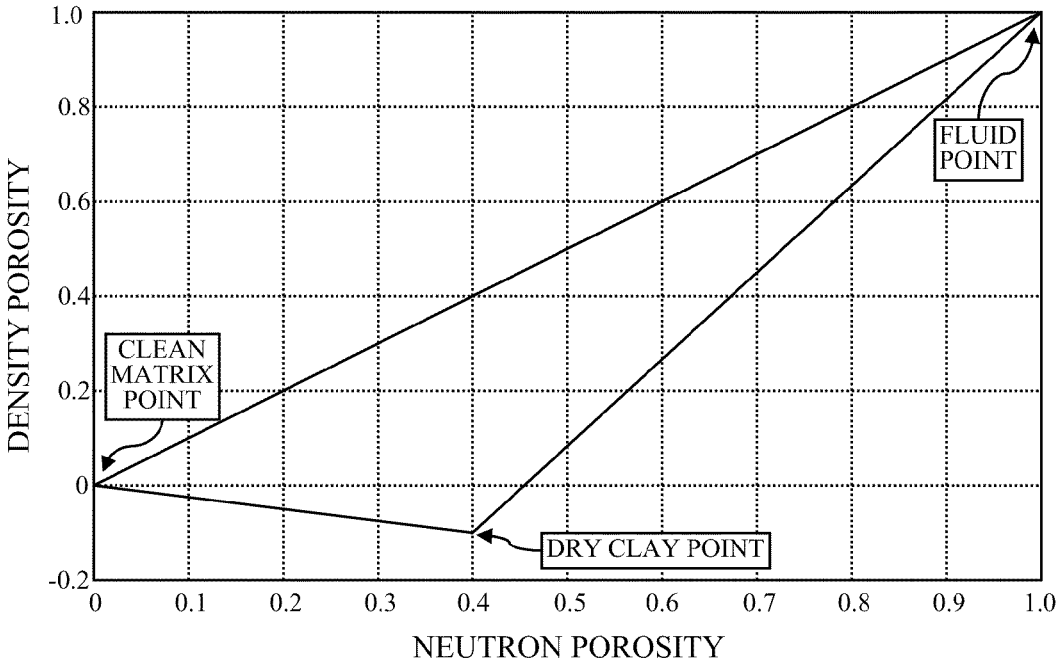
FIG. 12 is a chart demonstrating one or more aspects of the present disclosure.

FIG. 12 is a typical petrophysical interpretation positioning three points on a crossplot of the neutron porosity $\phi_N$ and the density porosity $\phi_D$: a clean matrix point, a dry clay point and a fluid point. The fluid point is a fresh water point with $\phi_N=1$ and $\phi_D=1$, the dry clay point is taken to be $\phi_{Ndcl}=0.40$ and $\phi_{Ddcl}=-0.10$, and the clean matrix point is $\phi_N=0$ and $\phi_D=0$.

Using this crossplot, the total porosity $\phi$, and the volume of dry clay $V_{dcl}$ are computed with the following formulas:

$$\phi_t = \frac{\phi_D \times \phi_{Ndcl} - \phi_N \times \phi_{Ddcl}}{\phi_{Ndcl} - \phi_{Ddcl}} \tag{1}$$

$$V_{dcl} = \frac{\phi_N - \phi_D}{\phi_{Ndcl} - \phi_{Ddcl}} \tag{2}$$

The volume of sand is deduced with:

$$V_{sand}=1-V_{dcl}-\phi_t \tag{3}$$

To create a scenario of time-lapse porosity variation, it is supposed that this variation is proportional to the porosity with a proportional parameter varying along the well, depending on the dry clay volume and bounded by a maximum value B with $0 \leqq B \leqq 1$.

The porosity at time $T_0$ is deduced directly from the total porosity log. Then, from year to year the porosity at times $T_1, \ldots, T_n$ is deduced from the porosity at times $T_0, \ldots, T_{n-1}$ with the following formulas:

$$\text{If } V_{dcl} \leqq 0.1 \text{ then, } \phi_{T_n}=(1-B)\,\phi_{T_{n-1}}$$

$$\text{If } 0.1 \leqq V_{dcl} \leqq 0.5 \text{ then, } \phi_{T_n}=(1-2.5\cdot B(0.5-V_{dcl}))\phi_{T_{n-1}}$$

$$\text{If } V_{dcl} \geqq 0.5 \text{ then, } \phi_{T_n}=\phi_{T_{n-1}} \tag{4}$$

The parameter B can be adjusted and has been taken equal to 0.1 in the present discussion.

These equations state that the porosity is not likely to change significantly in the zones where the volume of dry clay is important and greater than 0.5. The porosity may change as much as 10% year to year in the clean sand zones containing very little volume of dry clay (e.g., less than 0.1). The porosity changes linearly from 0% to 10% in zones where the volume of dry clay is between 0.5 and 0.1.

If the petrophysical interpretation presented before is not valid in the formation surrounding the grind and inject well, or if one of the porosity logs is not available, the variation of porosity with time may be estimated by supposing that this variation is proportional to the porosity with a proportional constant parameter along the well. In other words, Equation (4) can be simplified to $\phi_{T_n}=(1-B)\phi_{T_{n-1}}$ for all points along the well.

After the change in porosity along the well over time is estimated, a one-year time-lapse multi-dimensional model may be built.

The following equation relates density to porosity:

$$\rho=(1-\phi)\rho_m+\phi(S_w\rho_w+(1-S_w)\rho_f) \tag{5}$$

with $\rho$ the bulk density, $\phi$ the porosity, $\rho_m$, the rock matrix density, $S_w$ the water saturation, $\rho_w$ the water density, and $\rho_f$ the density of the fluid which is not water (e.g., oil or gas).

To build a time-lapse density model, the following approximations are made:

The density of the solids injected with the slurry is close to the density of the rock matrix $\rho_m$.

The density of the water injected with the slurry is close to the density of the water in the formation, $\rho_w$.

The density of the fluid $\rho_f$ in the formation remains the same throughout the injection process.

Under these assumptions, the time-lapse density change can be written:

$$\rho_{T_1}-\rho_{T_0}=(\phi_{T_1}-\phi_{T_o})(\rho_f-\rho_m)+(\phi_{T_1}S_{wT_1}-\phi_{T_0}S_{wT_0})(\rho_w-\rho_f) \tag{6}$$

For the grind and inject application, this equation simplifies. That is, the wells have been produced and we assume that the only fluid present near the wells is water. Therefore, water saturation equals 1 at all times. Consequently, the time-lapse density change is proportional to the time-lapse porosity change:

$$\rho_{T_1}-\rho_{T_0}=(\phi_{T_1}-\phi_{T_0})(\rho_w-\rho_m) \tag{7}$$

The estimation of the time-lapse porosity change, $(\phi_{T_n}-\phi_{T_{n-1}})$, due to slurry injection is done using some petrophysical interpretation, as described above and in Equation (4).

For a water injection application, Equation (6) would also simplify, because there is no porosity change over time. The time-lapse density change would be proportional to the time-lapse change of water saturation with:

$$\rho_{T_1}-\rho_{T_0}=\phi(S_{wT_1}-S_{wT_0})(\rho_w-\rho_f) \tag{8}$$

Thus, the time-lapse increase of water saturation due to water injection could be estimated roughly with for example a proportional change:

$$\text{If } CS_{wT_0}\leq 1 \text{ then, } S_{wT_1}=CS_{wT_0}$$

$$\text{If } CS_{wT_0}\geq 1 \text{ then, } S_{wT_1}=1 \tag{9}$$

C is a constant greater than 1. Its value would have to be adjusted depending on the local conditions and should reflect the expected increase in water saturation with time. Also, a more advanced petrophysical interpretation could be done to adjust its value depending on the characteristics of the formation along the well.

The multi-dimensional models may now be created. In the following paragraphs, the grind and inject application is taken as the primary application. However, the steps followed to create a multi-dimensional time-lapse model could be applied as-is to different applications, with either a slurry injection or a fluid injection, such as: injection of proppants during hydraulic fracturing of a subterranean formation and injection of liquid surfactants to improve hydrocarbon mobility, among others.

For building the input models for borehole gravity modeling, it is assumed that the injected slurry primarily expands horizontally in the perforation zone, and then in a second step goes up and down along the well. It is supposed that the slurry is expanding circularly from the well.

These assumptions can be translated into equations relating the radial extent r of the injected mass to the depth z and to the following parameters: $z_p$, the depth of the perforation middle point; $h_p$, the height of the perforation zone; and $\phi(z)$, the porosity. The radial extent of the mass injected is maximal in the perforation zone and varies according to the following function:

$$r(z)=\frac{R_0\phi(z)}{A} \tag{10}$$

This radial extent is decreasing in $$\frac{1}{|z-z_p|}$$

outside the perforation zone. Combining the depth and porosity dependence results in the following:

$$r(z)=\frac{R_0\phi(z)}{(A+|z-z_p|)} \tag{11}$$

It is linearly depending on the porosity everywhere.

The parameter $R_0$ is adjusted for mass balance such that:

$$\sum_{i,j,k}\Delta\rho_{i,j,k}V_{i,j,k}=M_{injected} \tag{12}$$

where $M_{injected}$ is the total mass injected in one year, $V_{i,j,K}$ is the volume of cell (i,j,k) and $\Delta\rho_{i,j,k}$ is the change of density in cell (i,j,k) for that year. The indices (i,j,k) represent a single grid cell of the multi-dimensional gridded model.

Figure 13:
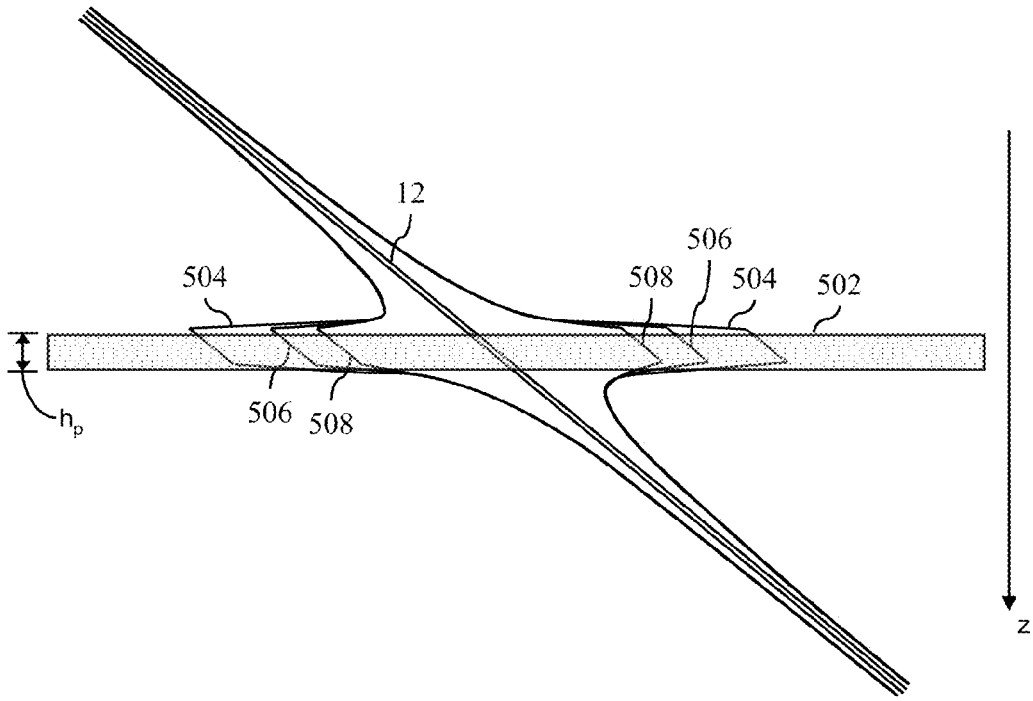
FIG. 13 is a schematic view demonstrating one or more aspects of the present disclosure.

The parameter A is an adjustable parameter which controls the shape of the volume of mass injected. FIG. 13 illustrates the radial extent of the mass injected around the well 12 near the perforation zone 502. The true vertical axis is depicted as "z". For a value of A=5, the shape of the volume in the subsurface where some mass has been injected is shown by lines 504. Lines 506 depict a value of A=7, and lines 508 depict a value of A=10. In multiple dimensions (e.g., 3D), this creates a gridded "circular shape" along the borehole based on this radial extent. Note that for all values of the parameter A, the mass contained in the multi-dimensional volume delineated by the various curves r(z) is identical.

The multi-dimensional time-lapse density model can be used to calculate the time-lapse response of a borehole gravity tool in the grind and inject well using the following equations:

$$g_Z=G\times\sum_{i,j,k}\frac{(Z_{i,j,k}-Z_{tool})\times\Delta\rho_{i,j,k}\times V_{i,j,k}}{((X_{i,j,k}-X_{tool})^2+(Y_{i,j,k}-Y_{tool})^2+(Z_{i,j,k}-Z_{tool})^2)^{\frac{3}{2}}} \tag{13}$$

$$\Delta g_Z(z)=g_Z(z+\Delta z/2)-g_Z(z-\Delta z/2) \tag{14}$$

where G is the Universal Gravitation Constant, $g_z$ is the component in the z direction of the acceleration due to gravity, $\Delta g_z(z)$ is the differential gravity at the depth of z, and $\Delta z$ is the distance between two station depths where the measurements are conducted.

The time-lapse density model and its associated borehole gravity tool response can be used in job planning for a borehole gravity survey. For example, it can be used to determine whether a survey is warranted based on the amplitude of the expected gravity response and the sensitivity of the gravity measurement instrument. Alternatively, the methods described above can be applied to a surface gravity survey.

Once a multi-dimensional model has been constructed, an initial gravity response is computed based on estimates for the values of parameters A, B and C. If actual measured gravity data is obtained, then it is possible to iteratively adjust the model parameters A, B and C to better match the computed gravity response to the measured data. The resulting model with optimized parameters A, B and C will be a representation of the actual location of injected materials to the extent that other assumptions in the model are correct.

Figure 14:
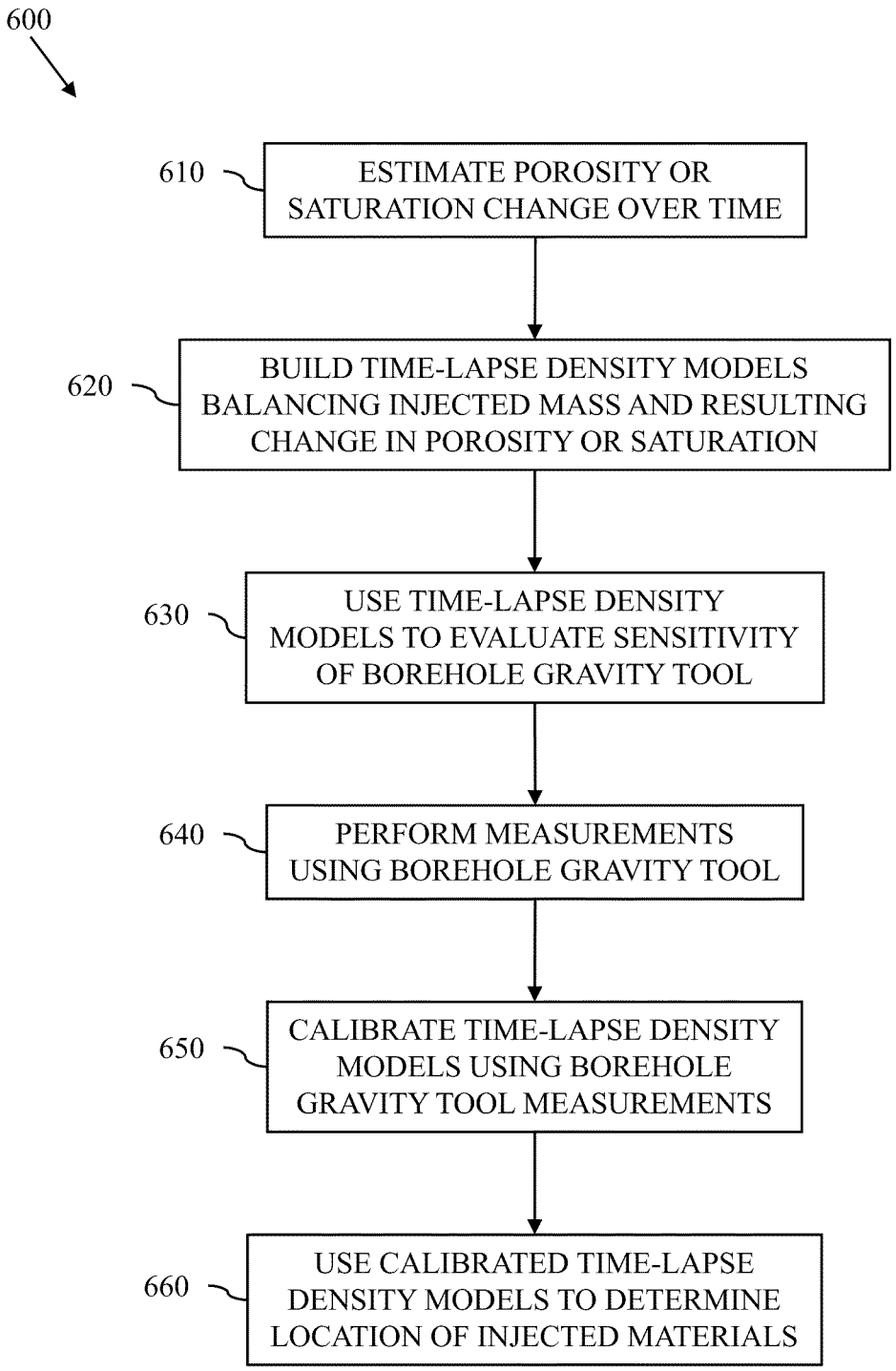
FIG. 14 is a flow-chart diagram of at least a portion of a method according to one or more aspects of the present disclosure.

FIG. 14 is a flow-chart diagram of at least a portion of a method 600 according to one or more aspects of the present disclosure. The method 600 may be or comprise an implementation of one or more of the aspects described above, and may be performed by or in conjunction with the apparatus shown in FIG. 1 and/or otherwise within the scope of the present disclosure.

The method 600 comprises a step 610 in which formation porosity and/or water saturation change is estimated. Such change may be estimated on an annual basis, such as by estimating the formation porosity and/or water saturation at year-long intervals. Step 610 may comprise obtaining well log data, core data, perforation data, injection data, well survey data, formation matrix density data, injected fluid density data, and/or combinations of these.

One or more time-lapse density models are then built in a step 620. The change in formation porosity and/or water saturation that was estimated during step 610 is utilized as at least one of the bases for the model(s), as well as balancing the mass of the fluid injected within the time period of investigation (e.g., during each of the intervals utilized in step 610).

The method 600 then proceeds to a step 630 during which the time-lapse density model(s) is (are) utilized to evaluate the sensitivity of a borehole gravity tool (e.g., the sonde 10 and/or gravity tool 20 shown in FIG. 1 and elsewhere in the present disclosure). In a subsequent step 640, the borehole gravity tool is utilized to perform gravity measurements at a plurality of stations along the well.

Thereafter, in a step 650, the time-lapse density model(s) is (are) calibrated using the borehole gravity tool measurements. For example, differences between projected and actual gravity measurements may be utilized to adjust one or more parameters of the model(s) (e.g., parameters A, B and/or C in the description above). The calibration of the time-lapse density model(s) performed in step 650 may include iterative adjustments to the one or more parameters of the model(s), such as where the incremental adjustments may iteratively repeat until the differences between the projected and actual gravity measurements fall below a predetermined threshold. Such threshold may be, for example, about 1%, although others are also within the scope of the present disclosure.

The method 600 may also include a step 660 in which the calibrated or otherwise adjusted model(s) is (are) utilized to determine the location of the injected materials. For example, the method 600 may be executed in the above-described context of grind and inject wells, such that the location and/or movement of the injected slurry of oilfield operations waste materials may be determined.

Other embodiments of the method 600 are also within the scope of the present disclosure. An exemplary embodiment of the method 600 may comprise steps 610, 620 and 630, and possibly other steps, but may omit steps 640, 650 and 660.

Figure 15:
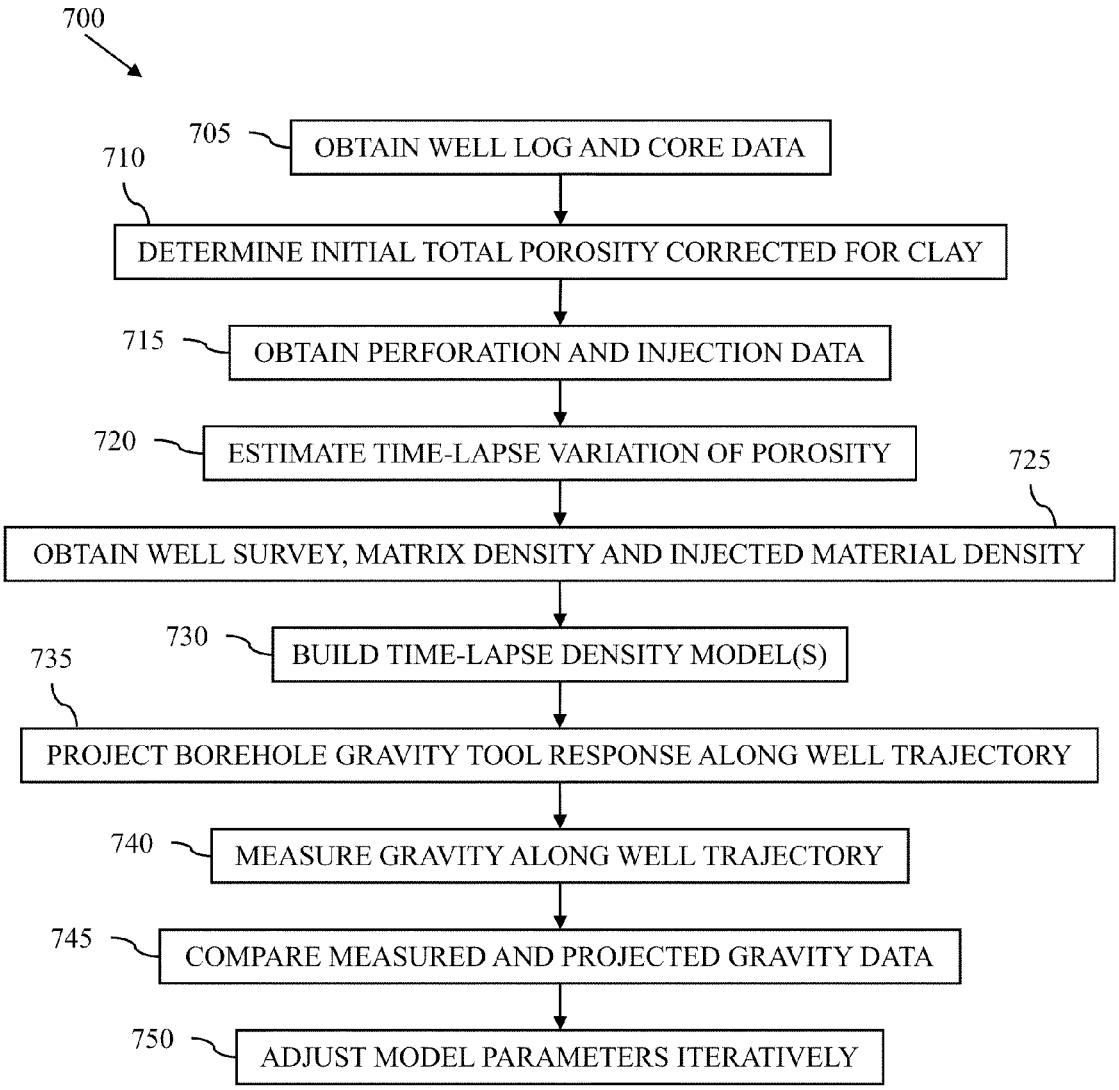
FIG. 15 is a flow-chart diagram of at least a portion of a method according to one or more aspects of the present disclosure.

FIG. 15 is a flow-chart diagram of at least a portion of a method 700 according to one or more aspects of the present disclosure. The method 700 may be or comprise an implementation of one or more of the aspects described above, and may be performed by or in conjunction with the apparatus shown in FIG. 1 and/or otherwise within the scope of the present disclosure. The method 700 may comprise or be performed in conjunction with one or more steps of the method 600 shown in FIG. 14.

The method 700 comprises a step 705 during which well log and core data is obtained. Such data may comprise natural gamma-ray data, neutron porosity data, gamma-gamma density data, resistivity data and/or core data. From this data, the initial total porosity of the formation may then be determined in subsequent step 710. Step 710 may further comprise correcting the total porosity of the formation based on an estimated and/or measured clay content of the formation.

Perforation and injection data is then obtained in subsequent step 715, although this may also occur prior to step 710, at least in part. The perforation data may comprise location of the various perforations that have been previously formed in the well, and may further comprise the time elapsed since each perforation was formed. The injection data may comprise the amount of fluid injected, the location of each injection (e.g., in relation to the perforations), the density of the fluid utilized for each injection, and/or the time elapsed since each injection. The total porosity, the perforation data and the injection data is then utilized in a subsequent step 720 to estimate a time-lapse variation of porosity of the formation resulting from the series of injections.

Well survey data, formation matrix density data and/or injected fluid density data is then obtained in a subsequent step 725, although this may also occur prior to steps 720 and/or 710, at least in part. This data may comprise a well survey obtained during or after drilling, matrix density obtained through core analysis and injected fluid density measured from fluid samples taken at the surface. From this data, one or more time-lapse density models are built during subsequent step 730, as described above.

In a subsequent step 735, a borehole gravity tool response at various stations along the well trajectory is projected using the one or more time-lapse density models built during step 730. Thereafter, in step 740, actual gravity measurements are obtained with the borehole gravity tool at the same or similar stations. The projected and actual gravity measurements are then compared in a step 745 to assess the accuracy of the time-lapse density model(s) developed during step 730.

The method 700 may also comprise a step 750 during which the one or more time-lapse density model(s) developed during step 730 are adjusted to account for differences between the projected and actual gravity measurements of steps 735 and 740. For example, one or more of the above-described parameters A, B and C may be adjusted to bring the projected gravity measurements of step 735 into accord with the actual gravity measurements of step 740.

Such adjustment may comprise an iterative procedure. For example, one or more of the parameters A, B and C may be incrementally adjusted to obtain new projected gravity measurements based on the adjusted time-lapse model(s). These new projected gravity measurements may then be compared to the actual gravity measurements to reassess the accuracy of the adjusted time-lapse model(s). If differences still exist between the projected and actual gravity measurements, or if the differences do not fall within a predetermined threshold, the model parameters may again be adjusted and the process repeated as necessary to sufficiently bring the model(s) into accord with the actual gravity measurements. In this manner, the time-lapse model(s) may be calibrated. Thereafter, the one or more time-lapse models may be utilized to assess the location and/or movement of the injected fluid within the formation.

Other embodiments of the method 700 are also within the scope of the present disclosure. An exemplary embodiment of the method 700 may comprise steps 705, 710, 715, 720, 725, 730 and 735, and possibly other steps, but may omit steps 740, 745 and 750.

Figure 16:
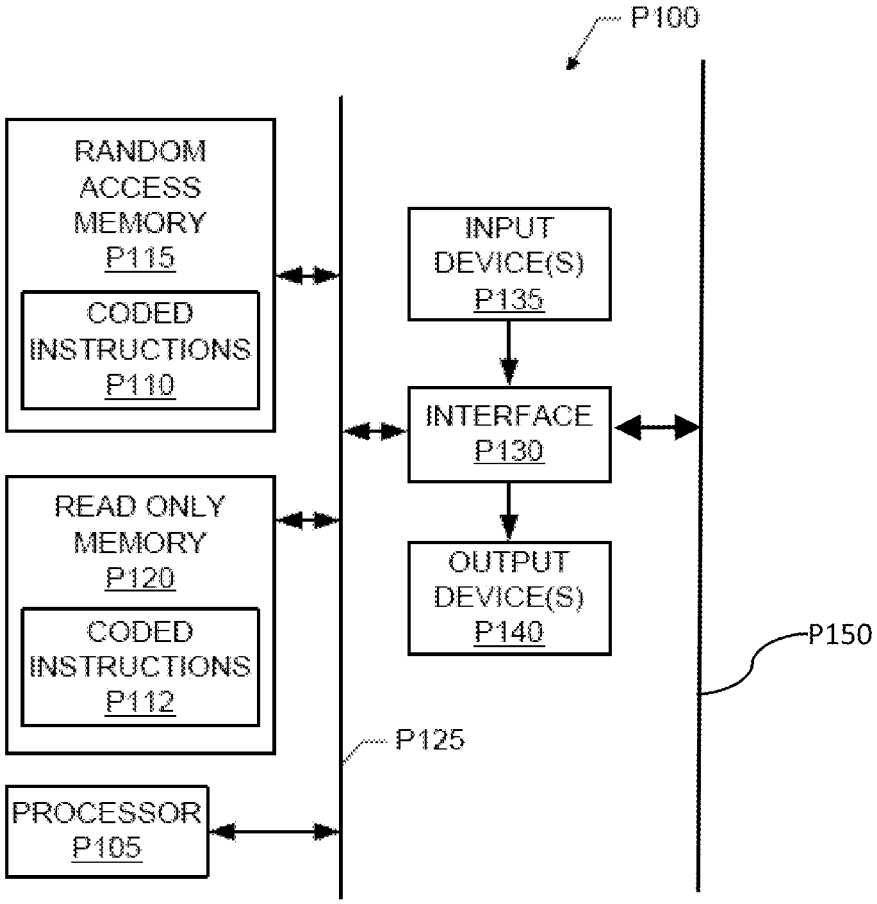
FIG. 16 is a schematic view of apparatus according to one or more aspects of the present disclosure.

FIG. 16 is a schematic view of at least a portion of an example computing system P100 that may be programmed to carry out all or a portion of the methods of the present disclosure. For example, the computing system P100 shown in FIG. 16 may be used to implement surface components (e.g., components located at the Earth's surface) and/or downhole components (e.g., components located in a downhole measuring tool) of a distributed computing system. The computing system P100 may be used to implement all or a portion of the electronics and processing components or system shown in FIG. 1 and/or otherwise within the scope of the present disclosure.

The computing system P100 may include at least one general-purpose programmable processor P105. The processor P105 may be any type of processing unit, such as a processor core, a processor, a microcontroller, etc. The processor P105 may execute coded instructions P110 and/or P112 present in main memory of the processor P105 (e.g., within a RAM P115 and/or a ROM P120). When executed, the coded instructions P110 and/or P112 may cause one or more components of the apparatus 10 of FIG. 1 and/or otherwise within the scope of the present disclosure to perform at least a portion of the method 600 of FIG. 14 and/or at least a portion of the method 700 of FIG. 15, among other methods within the scope of the present disclosure.

The computing system P100 may also include an interface circuit P130. The interface circuit P130 may be implemented by any type of interface standard, such as an external memory interface, serial port, general-purpose input/output, etc. One or more input devices P135 and one or more output devices P140 are connected to the interface circuit P130. The example output device P140 may be used to, for example, display, print and/or store on a removable storage media one or more of gravity, porosity and/or density data as described above.

The processor P105 may be in communication with the main memory (including a ROM P120 and/or the RAM P115) via a bus P125. The RAM P115 may be implemented by dynamic random-access memory (DRAM), synchronous dynamic random-access memory (SDRAM), and/or any other type of RAM device, and ROM may be implemented by flash memory and/or any other desired type of memory device. Access to the memory P115 and the memory P120 may be controlled by a memory controller (not shown). The memory P115, P120 may be used to store one or more of the operational parameters of the gravity sonde 20 of FIG. 1 and readings of the acceleration due to gravity within a subterranean formation, among other things.

Further, the interface circuit P130 may be connected to a telemetry system P150, including, for example, the multi-conductor cable 14 of FIG. 1. The telemetry system P150 may be used to transmit measurement data, processed data and/or instructions, among other things, between the surface and downhole components of the distributed computing system.

In view of all of the above and the figures, it should be clear that the present disclosure introduces a method comprising: estimating a change in a characteristic of a subterranean formation into which a fluid has been injected via a well extending into the subterranean formation; building a multi-dimensional model balancing mass of the injected fluid, wherein the model is based on the estimated characteristic change; utilizing the model to determine the sensitivity of a borehole gravity tool in the well; measuring gravity with the borehole gravity tool at a plurality of stations along the well; and utilizing the model and the gravity measurements to locate the injected fluid in the subterranean formation. The subterranean formation characteristic may be porosity and/or density. Building the model may be based on an estimated change in density of the subterranean formation which may be based on the estimated change in water saturation. The change in the characteristic of the subterranean formation may be estimated in intervals no shorter than about three months. The method may further comprise determining physical progression of the injected fluid on a year-by-year basis based on the model and the gravity measurements. The injected fluid may comprise a slurry, ground solid waste, or a slurry resulting from grinding solid waste generated by oilfield operations. The multi-dimensional model may be a 3D model or a 2½D model. The present disclosure also introduces apparatus comprising means for performing such a method.

The present disclosure also introduces a method comprising: determining total porosity of a subterranean formation into which a fluid has been injected via a well extending into the subterranean formation; estimating time-lapse variation of the porosity based on the total porosity, perforation data and injection data; building a time-lapse density model based on the estimated time-lapse variation of the porosity, formation matrix density data and injected fluid density data; and projecting a borehole gravity tool response at a plurality of stations along the well based on the time-lapse density model. Determining the total porosity of the subterranean formation may be based on well log data. The total porosity may be corrected to account for clay within the subterranean formation. The method may further comprise measuring gravity with the borehole gravity tool at each of the stations along the well. The method may further comprise adjusting a parameter of the time-lapse density model based on differences between the projected borehole gravity tool response and the measured gravity. Adjusting the parameter of the time-lapse density model may comprise iteratively adjusting the parameter of the time-lapse density model until the differences between the projected borehole gravity tool response and the measured gravity fall below a predetermined threshold. Adjusting the parameter of the time-lapse density model may comprise adjusting a plurality of parameters of the time-lapse density model based on the differences between the projected borehole gravity tool response and the measured gravity. Adjusting the plurality of parameters of the time-lapse density model may comprise iteratively adjusting the plurality of parameters of the time-lapse density model until the differences between the projected borehole gravity tool response and the measured gravity fall below a predetermined threshold. The multi-dimensional model is a 3D model or a 2½D model. The present disclosure also introduces apparatus comprising means for performing such a method.

The present disclosure also introduces an apparatus comprising means for performing at least one of a first method and a second method, wherein the first method comprises: estimating a change in a characteristic of a subterranean formation into which a fluid has been injected via a well extending into the subterranean formation; building a multi-dimensional model balancing mass of the injected fluid, wherein the model is based on the estimated characteristic change; utilizing the model to determine the sensitivity of a borehole gravity tool in the well; measuring gravity with the borehole gravity tool at a plurality of stations along the well; and utilizing the model and the gravity measurements to locate the injected fluid in the subterranean formation; and wherein the second method comprises: determining total porosity of the subterranean formation into which the fluid has been injected via the well; estimating time-lapse variation of the porosity based on the total porosity, perforation data and injection data; building a time-lapse density model based on the estimated time-lapse variation of the porosity, formation matrix density data and injected fluid density data; and projecting a borehole gravity tool response at a plurality of stations along the well based on the time-lapse density model. Such apparatus or means may be further configured to performed one or more aspects of other methods within the scope of the present disclosure.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A method, comprising:

estimating a change in a characteristic of a subterranean formation into which a fluid has been injected via a well extending into the subterranean formation;

building a multi-dimensional model balancing mass of the injected fluid, wherein the model is based on the estimated characteristic change;

utilizing the model to determine the sensitivity of a borehole gravity tool in the well;

measuring gravity with the borehole gravity tool at a plurality of stations along the well; and utilizing the model and the gravity measurements to locate the injected fluid in the subterranean formation.

2. The method of claim 1 wherein the subterranean formation characteristic is porosity.

3. The method of claim 1 wherein the subterranean formation characteristic is density.

4. The method of claim 3 wherein building the model is based on an estimated change in density of the subterranean formation which is based on the estimated change in water saturation.

5. The method of claim 1 wherein change in the characteristic of the subterranean formation is estimated in intervals no shorter than about three months.

6. The method of claim 1 further comprising determining physical progression of the injected fluid on a year-by-year basis based on the model and the gravity measurements.

7. The method of claim 1 wherein the injected fluid comprises a slurry.

8. The method of claim 1 wherein the injected fluid comprises ground solid waste.

9. The method of claim 1 wherein the injected fluid comprises a slurry resulting from grinding solid waste generated by oilfield operations.

10. The method of claim 1 wherein the multi-dimensional model is a 3D model or a 2½D model,

11. A method, comprising:

determining total porosity of a subterranean formation into which a fluid has been injected via a well extending into the subterranean formation;

estimating time-lapse variation of the porosity based on the total porosity, perforation data and injection data;

building a time-lapse density model based on the estimated time-lapse variation of the porosity, formation matrix density data and injected fluid density data; and projecting a borehole gravity tool response at a plurality of stations along the well based on the time-lapse density model.

12. The method of claim 11 wherein determining the total porosity of the subterranean formation is based on well log data.

13. The method of claim 11 wherein the total porosity is corrected to account for clay within the subterranean formation.

14. The method of claim 11 further comprising measuring gravity with the borehole gravity tool at each of the stations along the well.

15. The method of claim 14 further comprising adjusting a parameter of the time-lapse density model based on differences between the projected borehole gravity tool response and the measured gravity.

16. The method of claim 15 wherein adjusting the parameter of the time-lapse density model comprises iteratively adjusting the parameter of the time-lapse density model until the differences between the projected borehole gravity tool response and the measured gravity fall below a predetermined threshold.

17. The method of claim 15 wherein adjusting the parameter of the time-lapse density model comprises adjusting a plurality of parameters of the time-lapse density model based on the differences between the projected borehole gravity tool response and the measured gravity.

18. The method of claim 17 wherein adjusting the plurality of parameters of the time-lapse density model comprises iteratively adjusting the plurality of parameters of the time-lapse density model until the differences between the projected borehole gravity tool response and the measured gravity fall below a predetermined threshold.

19. The method of claim 11 wherein the multi-dimensional model is a 3D model or a 2½D model.

20. An apparatus, comprising:

means for performing at least one of a first method and a second method, wherein the first method comprises:

estimating a change in a characteristic of a subterranean formation into which a fluid has been injected via a well extending into the subterranean formation;

building a multi-dimensional model balancing mass of the injected fluid, wherein the model is based on the estimated characteristic change;

utilizing the model to determine the sensitivity of a borehole gravity tool in the well;

measuring gravity with the borehole gravity tool at a plurality of stations along the well; and utilizing the model and the gravity measurements to locate the injected fluid in the subterranean formation;

and wherein the second method comprises:

determining total porosity of the subterranean formation into which the fluid has been injected via the well;

estimating time-lapse variation of the porosity based on the total porosity, perforation data and injection data;

building a time-lapse density model based on the estimated time-lapse variation of the porosity, formation matrix density data and injected fluid density data; and projecting a borehole gravity tool response at a plurality of stations along the well based on the time-lapse density model.

* * * * *